United States Patent [19]

DeVincentis

[11] Patent Number: 4,461,102

[45] Date of Patent: Jul. 24, 1984

[54] SHOE WITH INTERCHANGEABLE SHOE STRAPS HAVING SPRING CONNECTORS

[76] Inventor: Cheryl A. DeVincentis, 102-21 Metropolitan Ave., Forest Hills, N.Y. 11357

[21] Appl. No.: 388,882

[22] Filed: Jun. 16, 1982

[51] Int. Cl.[3] ..... A43B 3/24; A43B 3/12

[52] U.S. Cl. ..... 36/101; 36/100; 36/11.5; 36/15; 24/265 H; 24/670

[58] Field of Search ..... 36/11.5, 101, 100, 15; 24/145, 146, 343, 363, 364, 370, 371, 201 HE, 228, 265 H

[56] References Cited

U.S. PATENT DOCUMENTS

| | | | |
|---|---|---|---|
| 804,024 | 11/1905 | Mills | 24/265 H |
| 2,607,133 | 8/1952 | Marlowe | 36/101 |
| 3,063,167 | 11/1962 | Scholl | 36/11.5 |
| 3,925,915 | 12/1975 | Colli | 36/11.5 |

FOREIGN PATENT DOCUMENTS

| | | | |
|---|---|---|---|
| 880043 | 5/1943 | France | 36/11.5 |
| 638232 | 6/1950 | United Kingdom | 36/11.5 |

*Primary Examiner*—Werner H. Schroeder
*Assistant Examiner*—Steven N. Meyers
*Attorney, Agent, or Firm*—Anthony J. Casella; Gerald E. Hespos

[57] ABSTRACT

A shoe with interchangeble shoe straps having spring connectors is provided. The spring connectors are affixed to opposite ends of each strap employed with the shoe. Each spring connector includes at least one loop spring which engages a stud securely affixed in the lower portion of the shoe. The spring connectors and straps can be easily interchanged but are not subject to unintentional disengagement. The spring connectors also provide a desirable amount of resiliency adding to the comfort of the shoe.

12 Claims, 10 Drawing Figures

SHOE WITH INTERCHANGEABLE SHOE STRAPS HAVING SPRING CONNECTORS

BACKGROUND OF THE INVENTION

Shoes include upper portions and lower portions, with the lower portion comprising the parts that are disposed intermediate the wearer's foot and the surface on which he or she is walking. The upper portion functions to at least partially cover the wearer's foot and to keep the lower portion in contact with the wearer's foot. To accomplish these functions, the upper portion is connected to the lower portion at a plurality of locations, and also engages the foot which is placed intermediate the upper and lower portions.

In addition to these purely functional aspects of shoes, it is generally desirable to have shoes that provide comfort and style. The comfort is afforded in part by providing an upper portion that is appropriately constructed to accept the wearer's foot and to accommodate the various movements, stresses, and strains that are placed upon the upper portion during normal wear. The style is attained by providing upper and lower portions that are aesthetically compatible with one another and that are both compatible with other attire with which the shoes will be worn.

To better accommodate the various styles and tastes of the shoe wearer, it is known to provide shoes in which the upper portions are separable from the lower portions. This has been most prevalent in shoes of a sandal design on which the upper portion consists merely of one or more straps. By this arrangement, the owner of the shoe can possess one pair of lower portions that can be used interchangeably with a plurality of pairs of upper portons. The wearer typically would select an upper portion that is consistent with other clothes he or she will be wearing, and will affix the selected upper portion with the standard lower portion. This enables the person to have a substantial shoe wardrobe that is compatible with other parts of their wardrobe, but that requires a relatively small capital expenditure. Examples of shoes that utilize these principles are shown in U.S. Pat. No. 2,153,968 to Loufbahn; U.S. Pat. No. 2,227,352 to Krasnosky; U.S. Pat. No. 2,395,767 to Sutcliffe; U.S. Pat. No. 2,509,335 to Dadisman; U.S. Pat. No. 2,526,940 to Fello; U.S. Pat. No. 2,976,623 to Gallaway; U.S. Pat. No. 3,037,302 to McDorman; U.S. Pat. No. 3,352,033 to Colley, and U.S. Pat. No. 3,925,915 to Colli.

The above cited references to Dadisman, Fello, McDorman, and Colli all show sandal type shoes in which a replaceable upper portion is woven or threaded through a specially designed lower portion. More particularly, the lower portion in these references includes specially mnaufactured slots and/or grooves through which members of the upper portion are threaded. Thus, although the replaceable upper portions are intended to reduce the expenditure on shoes, the specially manufactured lower portion can be significantly more expensive than the lower portion on a standard shoe. The reference to Krasnosky shows a shoe with a hinged lower portion to which straps are adjustably affixed by screws. In this shoe, the wearer would require special tools to change the upper portion. The references to Loufbahn and Cooli disclose shoes on which the upper portion is rigidly but removably snapped to the lower portion. The Sutcliffe reference shows a shoe having studs disposed about the perimeter of the lower portion.

The upper portion consists of a cord that is wrapped around the studs and then tied about the ankle. Although these upper portions are easily replaced, the shoe is difficult to put on, and the upper portion can easily bind against the foot causing discomfort to the wearer. The Gallaway reference shows a shoe having a hinge member built into the lower portion. The upper portion consists of a strap member that is wrapped through a portion of the hinge member. At least two of the hinge members are designed to fixedly retain opposed ends of the strap members.

In view of the above, it is an object of the subject invention to provide a new and improved shoe with interchangeable shoe straps.

It is another object of the subject invention to provide a shoe with interchangeable shoe straps that do not require specially manufactured lower shoe portions.

It is a further object of the subject invention to provide a shoe with interchangeable shoe straps and lower shoe portions that can be easily and inexpensively manufactured.

It is an additional object of the subject invention to provide shoes with interchangeable shoe straps that are aesthetically attractive.

It is still another object of the subject invention to provide a shoe on which the interchangeable shoe straps may be easily changed by the wearer.

It is still a further object of the subject invention to provide a shoe with interchangeable shoe straps that affords to the wearer enhanced comfort.

SUMMARY OF THE INVENTION

The subject invention is directed to a shoe with interchangeable shoe straps having resilient spring connectors for releasably attaching the shoe straps to the lower portion of the shoe. More particularly, at least one shoe strap is provided to define the upper portion of each shoe. The resilient spring connectors are affixed to opposed ends of each strap, and are removably attachable to the lower portion of the shoe.

Each spring connector preferably is constructed from a metallic spring wire, or a resilient plastic material, and includes a portion to which the strap is attached as well as at least one resilient spring loop portion attachable to the lower portion of the shoe.

The lower portion includes a plurality of mounting studs such as nails, brads or screws, inserted into the side edge of the lower portion, or protrusions formed integrally with the lower portion. These mounting studs include a head portion which is spaced from the side edge of the lower portion of the shoe by a distance at least equal to the thickness of the spring connectors. Additionally, the cross-sectional width of each mounting stud is such that after an initial resistance, the mounting stud can be readily engaged by the spring connector. As explained in greater detail below, this initial resistance ensures that the strap will not become disengaged from the lower portion of the shoe during use. However, the spring connector design is such that the straps can be easily removed from the shoe with minimum amount of force. Preferably, the front sections of the lower portions of shoes of any particular size are identical regardless of the lower portion style (e.g. flat, wedge, high heel). Thus, a single set of straps can be used with any of several different style lower portions that the wearer may own.

Resiliency is inherent to the construction of the spring connectors used in the subject invention. This resiliency enables the straps and the connectors to respond to forces exerted on them by the foot during normal use. More particularly, each spring connector will yield slightly to forces exerted upon it, but then will return to its normal position thereby affording to the user a degree of comfort that is uncommon. This slight yielding of the spring connectors avoids a binding of the straps into the foot, and also avoids forcing the metatarsal bones inwardly toward the center of the shoe. Thus, the wearer of the subject shoe is less likely to be bothered by blisters, calluses, bunions or corns. It is evident from the above that the subject spring connectors achieve a degree of synergism not found in the prior art in that they not only releasably connect the upper portion of the shoe to the lower portion, but they also provide resiliency to enhance the comfort.

The subject shoe with interchangeable shoe straps having reslient spring connectors not only meets functional demands, but also is adaptable to a wide range of styles. Specifically, the straps can be constructed from virtually any type or color material. Additionally, the straps comprising the upper portion of the shoe may be used with a lower portion manufactured in virtually any style and from any material. Furthermore, the straps may be arranged on the lower portion in a variety of patterns, (e.g. two criss-crossing straps, two parallel straps, two straps arranged in a V formation, a single strap, etc.). A single wide strap also can be employed by utilizing a spring connector that is wide enough to extend between mounting studs of the desired spacing. To accomplish this, the spring connector can skip over one or more mounting studs that are not sufficiently separated.

DETAILED DESCRIPTION OF THE PREFERRED EMBODIMENT

Figure 1:
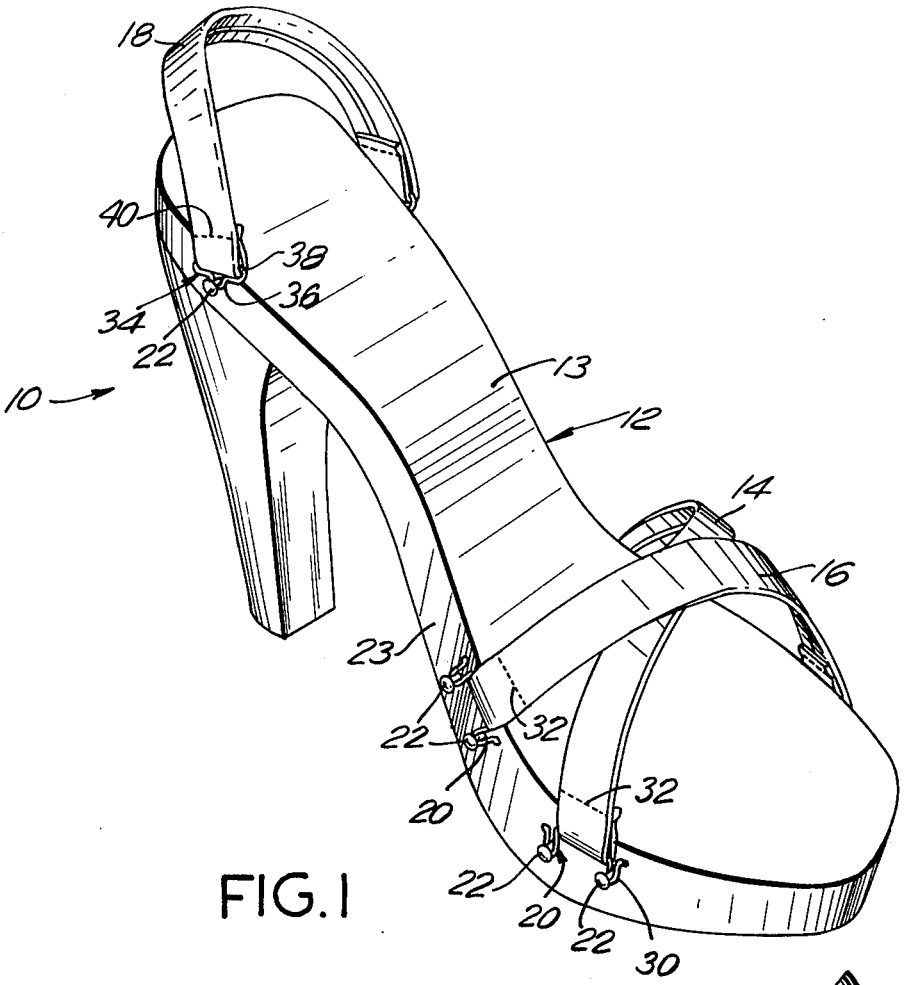
FIG. 1 is a perspective view of a shoe utilizing the subject interchangeable shoe straps with spring connectors.
Figure 2:
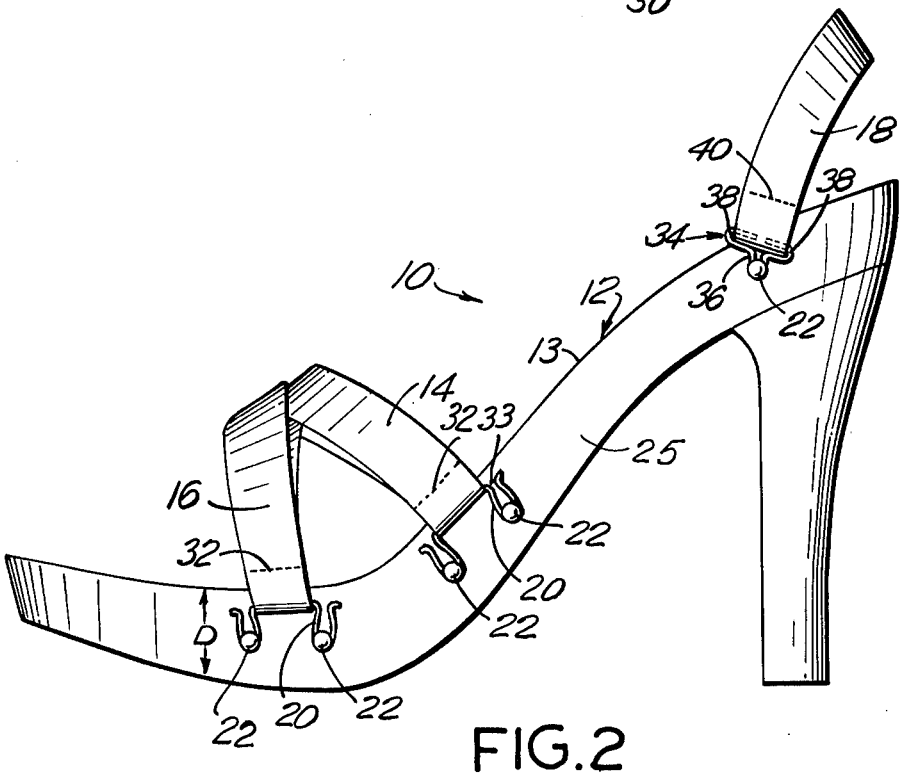
FIG. 2 is a side view of the shoe shown in FIG. 1.
Figure 3:
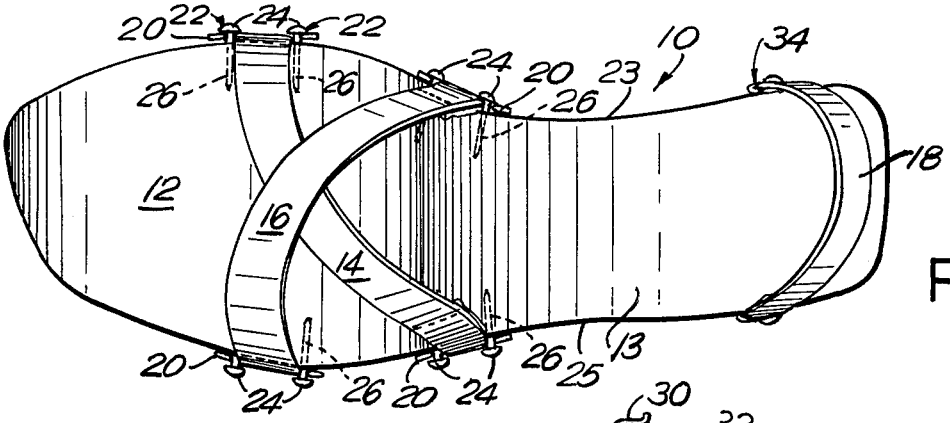
FIG. 3 is a top view of the shoe shown in FIG. 1.

The shoe 10 of the subject invevtion includes a lower portion 12 and an upper portion comprised of front straps 14 and 16 and rear strap 18, as shown in FIGS. 1, 2 and 3. Straps 14, 16 and 18 are constructed from a flexible but strong fabric material such as leather, vinyl or canvas. The front portion of the foot of the wearer is inserted between top surface 13 of lower portion 12 and front straps 14 and 16. Rear strap 18 then engages the upper part of the heel adjacent the archilles tendon. Thus, the front and heel portions of the foot are securely held in contact with the lower portion 12 of shoe 10. As explained further below, shoe 10 may be worn without rear strap 18.

FIG. 2 shows that front straps 14 and 16 are connected to lower portion 12 by spring connectors 20. More particularly, each end of front straps 14 and 16 is affixed to a spring connector 20 which in turn engages mounting studs 22.

As shown more clearly in FIG. 3, mounting studs 22 are nails or screws which include head portions 24 and penetrating portions 26. The length of each mounting stud 22 would be selected according to the material from which lower portion 12 is made. For example, with a shoe 10 having a lower portion 12 made of wood or wood products, a mounting stud 22 having a length between $\frac{3}{4}$ of an inch and 1 inch typically would be used. Mounting studs 22 are mounted into opposed sides 23 and 25 of lower portion 12 such that each mounting stud 22 extends substantially perpendicular to the portion of side 23 or 25 of lower portion 12 adjacent to that stud 22. Additionally, the penetrating portion 26 of each mounting stud 22 extends substantially parallel to the top surface 13 of lower portion 12.

Each mounting stud 22 extends into side 23 or 25 of lower portion 12 a sufficient distance such that the head 24 thereof is separated from side 23 or 25 of lower portion 12 by a distance at least equal to the thickness of spring connector 20. Typically, this separation between the head 24 of mounting stud 22 and side 23 or 25 of lower portion 12 of shoe 10 will be approximately $\frac{1}{8}$ of an inch.

Figure 4:
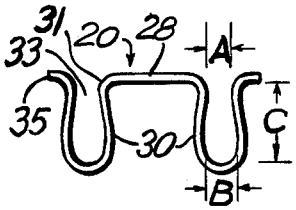
FIG. 4 is a plan view of the spring connector for use with the interchangeable shoe straps of the subject invention.
Figure 5:
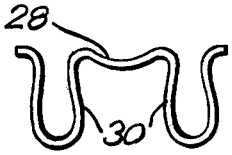
FIG. 5 is a plan view of a second embodiment of the subject spring connector.
Figure 6:
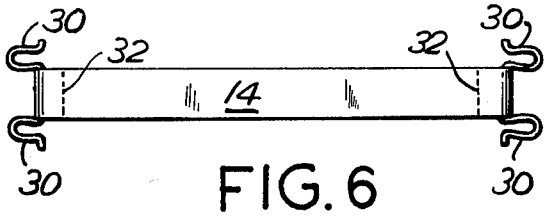
FIG. 6 is a plan view of the interchangeable shoe strap with spring connectors of the subject invention.

Front spring connector 20 is shown most clearly in FIGS. 4 and 5. Each front spring connector 20 is fabricated from a metallic spring wire or a resilient plastic material. For example, copper or galvanized spring wire having a diameter of 0.037 inches has been found to be very effective. Each front spring connector 20 has a generally U-shaped configuration in which strap mounting portion 28 defines the base of the U-shape, and loop springs 30 define the opposed legs thereof. Strap mounting portion 28 may either be straight as shown in FIG. 4, or may be slightly bowed, as shown in FIG. 5. The configuration of strap mounting portion 28 shown in FIG. 5 adds to the resiliency of spring connector 20. The length of strap mounting portion 28 corresponds to the width of straps 14 and 16. This relationship is shown more clearly in FIG. 6. Specifically, each opposed end of strap 14 or 16 is wrapped around strap mounting portion 28 of spring connector 20 and is sewn or otherwise secured in this position at seam 32. This connection enables strap 14 or 16 to slide on or rotate about strap mounting portion 28 thus contributing to the comfort of shoe 10.

Substantially, identical resilient loop springs 30 extend from opposed ends 31 of the strap mounting portion 28 on each spring connector 20. Each loop spring 30 includes an open portion 33 defined by the free end 35 of loop spring 30 and the end 31 where loop spring 30 and strap mounting portion 28 intersect. The width of the open portion 33 of each spring loop 30 is defined by the dimension "A" in FIG. 4, and is selected to be slightly less than the diameter of the penetrating portion 26 of each stud 22. The lower portion of each loop spring 30 has a width, defined by the dimension "B" in FIG. 4, equal to or slightly greater than the diameter of the penetrating portion 26 of stud 22. The relationship between the dimensions "A" and "B" of loop springs 30 and the diameter of the penetrating portion 26 of each stud 22 is such that a minor force will be required to mount each loop spring 30 on its respective stud 22. Similarly, a slight force will be required to remove each loop spring 30 from its respective stud 22. Thus, front straps 14 and 16 can be easily changed by the wearer of the shoe 10, but are not likely to become accidentally disengaged from studs 22.

The structure of spring connectors 20 inherently provides additional functional advantages. Specifically, the spring wire construction of spring connector 20 ensures that each loop spring 30 will retain substantially its original shape even after many uses. Additionally, the spring construction of spring connector 20 provides a resiliency in the connection between front straps 14 and 16 and lower portion 12 of shoe 10. Thus, as forces are exerted on front straps 14 and 16, during walking, the loop springs 30 of each spring connector 20 will yield slightly thereby minimizing the tendency of front straps 14 and 16 to bind into the foot of the wearer and thereby avoid forcing the metatarsal bones inwardly toward the center of the shoe. After release of this force exerted by the foot during walking, the biasing forces of each spring connector 20 will cause each spring connector 20 to return to substantially its original position. In this matter the unique spring connectors 20 have a synergistic effect in that they enable releasable mounting on studs 22, and they alternately yield and biasingly return to shape in response to forces exerted during walking. It is important to emphasize that the yielding movement of each spring connector 20 is relatively small for the spring size and wire gauge described above. As a result, the shoe wearer will not perceive the fit of the subject shoe as being sloppy. It should also be emphasized that the movement referred to herein occurs entirely within spring connector 20. Consequently, there is no frictional interaction between the foot of the wearer and front straps 14 and 16.

The length of each loop spring 30 as defined by dimension "C" in FIG. 4, is in part a function of the height of sides 23 or 25 of lower portion 12 adjacent to studs 22 as defined by dimension "D" in FIG. 2. Specifically, each stud 22 will be inserted centrally into side 23 or 25 of lower portion 12. More specifically, each stud would be a distance from the top surface 13 of lower portion 12 approximately equal to one half "D". Dimension "C", as shown in FIG. 4, would be selected to ensure that neither strap mounting portion 28 nor free end 35 of each spring connector 20 extends above the top surface 13 of lower portion 12. Thus, in most instances, dimension "C" would be less than or equal to one half of dimension "D". By this arrangement, neither the ends of front straps 14 or 16 nor the free end 35 of spring connector 20 would be visible above the upper surface of lower portion 12, thereby contributing to the aesthetic attractiveness of shoe 10.

Returning to FIGS. 1 and 2, shoe 10 is provided with a rear strap 18. Rear strap 18 is attached to lower portion 12 by rear spring connector 34 which employs the same principles as spring connector 20 described above, but is designed differently. Specifically, rear spring connector 34 has only one loop spring 36 rather than the two loop springs 30 provided on spring connectors 20. Extending from each side of loop spring 36 on rear spring connector 34 are strap mounting loops 38. Strap mounting loops 38 are substantially U-shaped having their respective open portions facing one another so as to define a slot through which strap 18 may be inserted. Strap 18 then is secured to itself at seam 40. The structure of rear spring connector 34 enables it to pivot around the stud 22 engaged by the loop spring 36 thereof. This rotational movement substantially facilitates the comfortable positioning of back strap 18 above the heel of the wearer. The structure of rear spring connector 34 also provides the synergy of spring connector 20 in that it releasably mounts on lower portion 12, plus it has the resilient characteristics that enhance the comfort of shoe 10.

Figure 7:
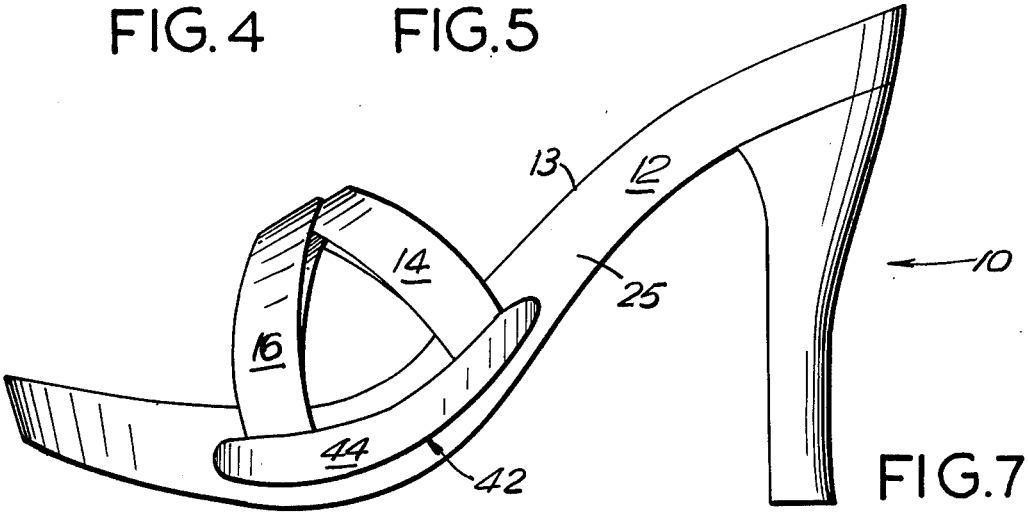
FIG. 7 is a side view of a shoe employing alternate mounting members for the interchangeable shoe strap with spring connectors of the subject invention.
Figure 8:
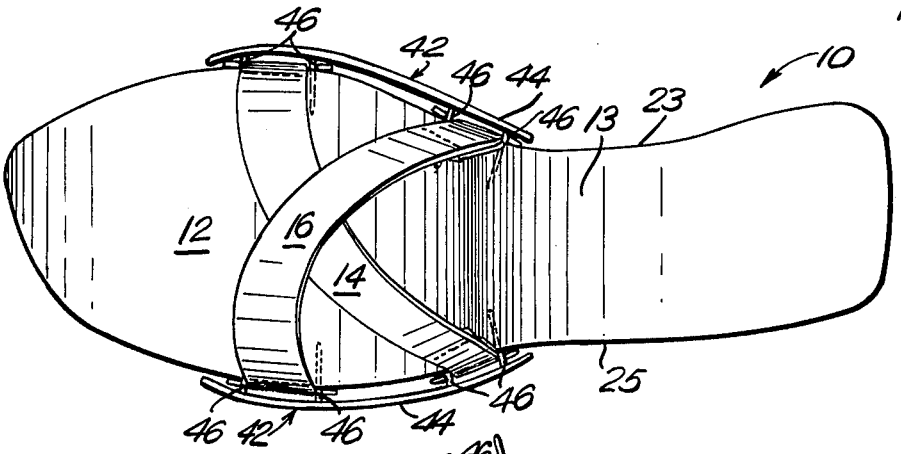
FIG. 8 is a top view of the shoe shown in FIG. 7.
Figure 9:
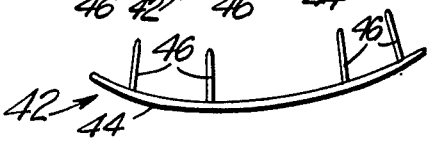
FIG. 9 is a plan view of the mounting member shown in FIG. 7.

FIGS. 7 and 8 show the interchangeable shoe straps with spring connectors of the subject invention employed with a shoe having no back strap. Additionally, the shoe 10 shown in FIGS. 7 and 8, employs a mounting plate 42 instead of individual studs 22. Mounting plate 42 includes a single unitary head portion 44 from which extends a plurality of mounting portions 46. Mounting plate 42 may be formed integrally with lower portion 12, if for example, lower portion 12 is constructed from a plastic material. On the other hand, mounting plate 42 can define a separate member, as shown in FIG. 9, wherein mounting portions 46 are urged into the lower portion 12 of shoe 10 in a manner similar to that described above for stud 22. In utilizing the mounting plate 42, shown in FIG. 9, mounting portions 46 are urged into lower portion 12 of shoe 10 a distance to securely fasten mounting plate 42 to lower portion 12. Also, as shown most clearly in FIG. 8, unitary head member 44 is separated from lower portion 12 by a distance sufficient to enable the insertion of spring connectors 20 therebetween. Mounting plate 42 offers several desirable advantages. First, it minimizes wear on the ends of straps 14 and 16 adjacent to spring connectors 20. Second, it minimizes the possibility of inadvertent contact with and damage to spring connectors 20 during normal walking. Third, it provides an aesthetic effect that would be considered desirable in many situations. Head portion 44 of plate 42 may be constructed from any strong and aesthetically attractive material such as brass or stainless steel. Additionally, head portion 44 can be used to display the trade name of the shoe manufacturer.

Figure 10:
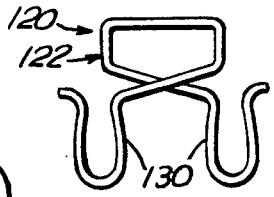
FIG. 10 is a plan view of a third embodiment of the subject spring connector.

FIG. 10 shows a spring connector 120 that is particularly well adapted for use with the mounting plate 42, shown in FIGS. 7 through 9. Specifically, spring connector 120, shown in FIG. 10, has a strap mounting loop 122 that is large enough to be grasped easily when it is used with the mounting plate 42 that is shown in FIG. 7. Thus, spring connector 120 can be mounted and removed with extreme ease. More particularly, the spring connector 120 includes a pair of loop springs 130 which are equivalent to the loop springs 30 described above. The strap mounting loop 122 is defined by criss-crossing the wire or plastic member joining the loop springs 130. The strap used with spring connector 120 can be wrapped entirely around strap mounting loop 122 so as to completely conceal strap mounting loop 122. It is important to note that spring connector 120 can be used with the previously described mounting studs, and can provide an added amount of resiliency.

In summary, a shoe is provided having interchangeable shoe straps with spring connectors. The spring connectors are constructed from a spring wire, and are affixed to the end portions of the straps which define the upper portion of the shoe. Each spring connector includes at least one loop spring portion by which the spring connector is attached to the lower portion of the shoe. The loop springs of the spring connectors are resilient and have an open end which is biased to a narrower width than the lower portion thereof. The spring connectors are attached to a stud or mounting plate securely affixed to the lower portion of the shoe. The straps can be easily interchanged by exerting appropriate pressure on the spring connector to either engage or disengage the studs.

What is claimed is:

1. A shoe with interchangeable shoe straps comprising:

a lower portion having opposed top and bottom surfaces and opposed side edges extending between and connecting said top and bottom surfaces;

at least one pair of spaced apart strap mounting studs extending from one said edge and at least another pair of spaced apart strap mounting studs extending from the opposed side edge thereof, each said strap mounting stud including a head portion spaced from the respective edge;

at least one pair of spring connectors, each said spring connector having a strap mounting portion about which a strap may be wrapped, and having a pair of resilient loop springs connected to said strap mounting portion and extending generally parallel to one another away from the strip mounting portion, each said loop spring including an open portion dimensioned to accept one said strap mounting stud with the spacing between the studs in each said pair of strap mounting studs, said loop springs of one spring connector in each said pair of spring connectors releasably engaging said pair of strap mounting studs extending from one said side edge, and the loop springs of the other spring connector in each said pair of spring connectors releasably engaging the pair of strap mounting studs extending from the opposed side edge; and an elongated strap for each said pair of spring connectors, said elongated strap having a width substantially equal to the distance between said loop springs in each said spring connector, said elongated strap having opposed ends, said opposed ends being wrapped around and connected respectively to the strap mounting portions of each spring connector in said pair of spring connectors such that the portions of said strap which are wrapped around said strap mounting portions are disposed entirely intermediate the resilient loop springs of the respective spring connectors whereby the pair of spring connectors and the associated strap define an upper portion of said shoe and whereby said straps and said spring connectors resiliently yield to forces exerted thereon and are removably mounted to said strap mounting studs.

2. A shoe in claim 1 wherein each of said spring connectors has a U-shaped configuration, the base portion of said U-shaped spring connector being defined by said strap mounting portion and each leg of said U-shaped spring connector being defined by one said resilient loop spring.

3. A shoe as in claim 2 wherein each said resilient loop spring of said U-shaped spring connector includes a first end connected to and extending from said strap mounting portion and a second end separated from said first end by a distance less than the cross sectional width of said strap mounting stud, said open portion of each said loop spring being defined by the separation between said first and second ends.

4. A shoe as in claim 2 wherein the strap mounting portion of each said spring connector extends intermediate the opposed top and bottom surfaces of said lower portion.

5. A shoe as in claim 1 wherein said lower portion includes front and rear sections, with at least one said strap mounting stud being disposed on each said opposed side edge along the rear section of said lower portion and further including a pair of rear spring connectors, each said rear spring connector including one resilient loop spring and a strap mounting portion defined by two opposed strap mounting loops extending from opposed ends of said rear spring connector loop spring, said strap mounting loops being substantially U-shaped and having their respective open portions facing one another so as to define a slot through which a strap may be inserted, each said rear spring connector loop spring releasably and resiliently engaging said strap mounting studs extending from said rear section of lower portion, and wherein one said elongated strap is a rear strap slidably inserted through said slot and attached to said pair of rear spring connectors.

6. A shoe as in claim 1 wherein each said spring connector is formed from a unitary piece of metallic spring wire.

7. A shoe as in claim 6 wherein said spring wire is formed from copper or galvanized metal.

8. A shoe as in claim 1 wherein each said spring connector is formed from a unitary piece of plastic material.

9. A shoe as in claim 8 wherein said strap mounting studs and said lower portion are formed from a unitary piece of material.

10. A shoe as in claim 1 wherein said strap mounting portion is a strap mounting loop extending continuously from said pair of loop springs.

11. A shoe with interchangeable shoe straps comprising:

a lower portion having opposed top and bottom surfaces and opposed side edges extending between and connecting said top and bottom surfaces;

at least one pair of strap mounting studs extending from one said edge and at least another pair of strap mounting studs extending from the opposed side edge thereof;

at least one pair of U-shaped spring connectors each have a base portion and two opposed legs, the base portion of each said U-shaped spring connector defining a strap mounting portion to which a strap may be connected and each said leg defining a resilient loop spring, said strap mounting portion of said U-shaped spring connector being bowed toward the open end of the U-shape thereby providing increased resiliency to said U-shaped spring connector said loop springs of one spring connector in each said pair of spring connectors engaging said strap mounting studs extending from one said side edge and the loop springs of the other spring connector in each said pair of spring connectors engaging the strap mounting studs extending from the opposed side edge;

and an elongated strap for each said pair of spring connectors, said elongated strap having opposed ends, said opposed ends being connected respectively to the strap mounting portions of each spring connector in said pair of spring connectors whereby the pair of spring connectors and the associated strap define an upper portion of said shoe and whereby said straps and said spring connectors resiliently yield to forces exerted thereon and are removably mounted to said strap mounting studs.

12. A shoe with interchangeable shoe straps comprising:

a lower portion having opposed top and bottom surfaces and opposed side edges extending between and connecting said top and bottom surfaces;

a plurality of strap mounting studs connected to one another by a common head portion and extending from one said edge such that said head portion is spaced from said edge, and a second plurality of mounting studs connected to one another by a common head portion and extending from the opposed side edge such that the head portion of said second plurality is spaced from said opposed side edge;

at least one pair of spring connectors, each said spring connector having a strap mounting portion to which a strap may be connected and having at least one resilient loop spring, said loop spring of one spring connector in each said pair of spring connectors engaging said strap mounting stud extending from one said side edge and the loop spring of the other spring connector in each said pair of spring connectors engaging the strap mounting stud extending from the opposed side edge; and an elongated strap for each said pair of spring connectors, said elongated strap having opposed ends, said opposed ends being connected respectively to the strap mounting portions of each spring connector in said pair of spring connectors whereby the pair of spring connectors and the associated strap define an upper portion of said shoe and whereby said straps and said spring connectors resiliently yield to forces exerted thereon and are removably mounted to said strap mounting studs.

* * * * *